US005778788A

United States Patent [19]

Pettersson

[11] Patent Number: 5,778,788

[45] Date of Patent: Jul. 14, 1998

[54] SHEET OFFSET PRESS

[75] Inventor: Kjell Pettersson, Tranas, Sweden

[73] Assignee: IVT Graphics AB, Sweden

[21] Appl. No.: 666,453

[22] PCT Filed: Dec. 29, 1994

[86] PCT No.: PCT/SE94/01265

§ 371 Date: Aug. 28, 1996

§ 102(e) Date: Aug. 28, 1996

[87] PCT Pub. No.: WO95/18017

PCT Pub. Date: Jul. 6, 1995

[30] Foreign Application Priority Data

Dec. 30, 1993 [SE] Sweden ..... 9304337

[51] Int. Cl.[6] ..... B41F 35/00

[52] U.S. Cl. ..... 101/424.1; 101/488; 34/266; 432/242

[58] Field of Search ..... 101/424.1, 488, 101/487, 419, 416.1; 34/278, 277, 274, 273, 266, 267, 272; 15/88.1, 77; 432/242, 64, 115; 392/416, 417

[56] References Cited

U.S. PATENT DOCUMENTS

| | | | |
|---|---|---|---|
| 1,361,977 | 12/1920 | Fuller | 34/242 |
| 2,724,908 | 11/1955 | Shaw | 34/242 |
| 4,146,974 | 4/1979 | Pray | 34/54 |
| 4,287,826 | 9/1981 | Brabec | 101/115 |
| 4,370,534 | 1/1983 | Brandon | 219/10.55 |
| 4,646,446 | 3/1987 | Bubley | 34/278 |
| 4,773,167 | 9/1988 | Jacobi, Jr. | 34/277 |
| 5,085,680 | 2/1992 | Bender et al. | 432/242 |
| 5,259,124 | 11/1993 | Poterala | 34/242 |
| 5,537,925 | 7/1996 | Secor et al. | 101/424.1 |

FOREIGN PATENT DOCUMENTS 0223490 5/1987 European Pat. Off. .

*Primary Examiner*—Edgar S. Burr
*Assistant Examiner*—Anthony H. Nguyen
*Attorney, Agent, or Firm*—Ostrolenk, Faber, Gerb & Soffen, LLP

[57] ABSTRACT

The invention relates to an apparatus for offset presses, and includes an air-IR drying box, through which ready printed sheets are caused to be conveyed with the aid of a sheet gripping shaft, for the purpose of drying pigment deposited on the sheets. The box has top and bottom sections separated at each lateral side by a gap between the sections. Brushes along the gaps delimit the box laterally. The brush at each lateral side comprises brush material covering the respective gap and extending perpendicularly to the conveying direction for preventing the spread of heat radiation and hot air from the IR lamps in the box to different machine parts of the press. The gripping shaft is of a length to extend through the gaps and to deflect the brush material as the shaft passes along the gap.

10 Claims, 1 Drawing Sheet

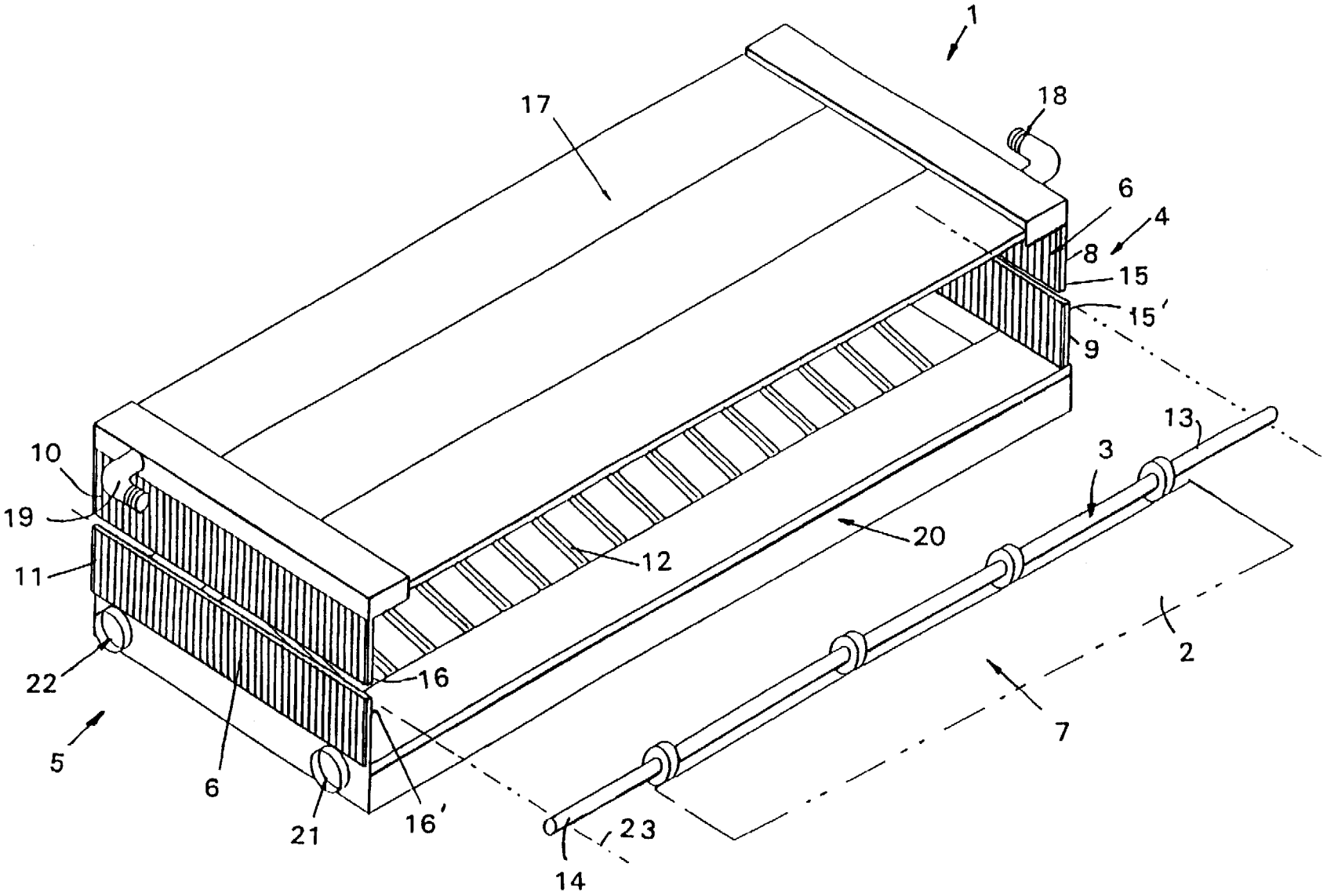
1
2
3
4
5
6
6
7
8
9
10
11
12
13
14
15
15'
16
16'
17
18
19
20
21
22
23

SHEET OFFSET PRESS

BACKGROUND OF THE INVENTION

The present invention relates to an apparatus for offset presses and includes an air-infra-red (IR) drying box, through which ready-printed sheets are caused to be conveyed with the aid of gripping means, for the purpose of drying pigment deposited on the sheets.

A continually recurring problem with the installation of IR drying boxes in offset presses is that the IR lamps radiate to some extent heat up metallic parts of the press, including its frame sides and the gripping means conveying the sheets. Several attempts have already been made to screen off the IR lamps, but the problem lies with the gripping means that have to pass the place where the box is mounted.

SUMMARY OF THE INVENTION

The object of the present invention is to achieve an effective heat barrier in offset presses, the barrier allowing the gripping means to pass while at the same time preventing the heat radiation from the IR lamps from spreading to the different machine parts of the press. The distinguishing features of the invention are heat resistant brushes arranged at the gaps laterally delimiting at air-IR drying box so that the sheet supports can extend outside the box through the brush material while the brush material defines a heat barrier for the box.

Due to the present invention there has now been achieved an effective heat barrier in offset presses of the kind mentioned in the introduction, the barrier fulfilling its purpose in an excellent manner, while at the same time it is both simple and cheap to manufacture, as well as easy to fit. The inventive heat barrier comprises heat resistant brush material arranged at the gaps laterally delimiting an air-IR drying box and its IR lamps, this box being mounted on an offset press. This brush material is made from a heat-resisting substance, which is also heat-insulating and flexible. It is therefore possible to mount and adjust mutually opposing lengths of the brush material such as to completely cover the gaps laterally delimiting the box, while allowing passage of gripping means through it, since filaments of brush material will be deflected as respective portions of the gripping means come into contact with them, and will return immediately to their original attitudes after passage of the gripping means. The brush material does not cause any damage to the portions of the gripping means with which it engages, and it can be supplied with relatively long brush filaments that can be trimmed to a suitable length on installation. In addition, a brush comprising the brush material may be fastened to a rail, which is flexible in the conveying direction of the sheets, curved guides used with the gripping means thus not causing any problem.

BRIEF DESCRIPTION OF THE DRAWING

The invention will now be described in more detail with the aid of a preferred embodiment example and with reference to the accompanying drawing, which depicts a schematic, perspective view of an air-IR drying box installed on an offset press.

DESCRIPTION OF A PREFERRED EMBODIMENT

As will be seen from the drawing, the air-IR drying box 1, intended for mounting on an offset press, is adapted to accept ready-printed sheets 2 for drying the pigment deposited thereon, these sheets being conveyed with the aid of gripping means 3. IR lamps 12 are mounted in the box 1 in given, spaced relationship, and in the illustrated example, in the conveying direction of the sheets 2. The gaps 4 and 5 laterally delimiting the box 1 are each screened by at least brush means 6 extending in the conveying direction 7 of the sheets 2 and comprising respective brush material 8, 9 and 10, 11 for closing off the respective gap and preventing the spread of IR radiation and hot air generated by the IR lamps in the box 1 to different components of the offset press.

According to the preferred embodiment example depicted on the drawing, the laterally delimiting gaps 4 and 5 between the respective side elements are each screened off by brush means 6 extending in the conveying direction. The brush material 8-11 of the means 6 is both heat-resistant and heal-insulating, as well as having a flexibility permitting the gripping means 3 to pass. The filaments in the respective mutually opposed brush means 6 have their outer, free portions 15, 15', 16, 16', mutually, opposingly directed and preferably extend completely across the gaps 4 and 5 such as effectively to close off the gaps. These outer free portions 15; 15'; 16; 16' of the respective brush material 8-11 are mutually contiguous along a line 23, which is at the same level as the central point of, and conveying path for the portions 13, 14 of a gripping means 3, these portions being intended to be taken through, between and along brush means 6 as the gripping means 3 is advanced through the air-IR drying box 1. The outer free portion of the brush material 8-11 of the respective brush means 6 preferably extends over the entire gaps 4 and 5 both from above and below such as to meet along the middle of the respective gap. To enable the use of curved gripping means guides 3 the brush material 8-11 may be fastened to a rail, which is flexible in the sheet conveying direction 7. By reason of the great flexibility of the brush material 8-11 it is possible to adjust it so that opposing filaments touch a passing gripping means 3, merely deflecting the filaments until it passes between them, subsequent to which they immediately return to their original attitudes. The brush material can be delivered with relatively long filaments, for clipping to appropriate length on installation. The preferred embodiment of the air-IR box 1 illustrated on the drawing includes an upper, water-cooled reflector 17, having connections 18, 19 for cooling water. The lower part of the box 1 includes an IR lamp array 20, and in the illustrated embodiment cold air, via connections 21 and 22, is used to cool it. It is of course also possible to provide an inverted set-up with the reflector 17 below and the array 20 above, such as to obtain fully effective function.

I claim:

1. Apparatus for use in an offset press wherein the press includes an air-infra-red (IR) drying box with infrared drying lamps disposed therein and the box defines a pathway through which individual printed sheets may be passed in sequence for drying the pigments deposited on the sheets;

the apparatus comprising the box including separated upper and lower sections having lateral sides and with a respective gap between the sections at each lateral side, gripping means for moving the sheets in a conveying direction between the sections and the gripping means being of such length and being so positioned as to extend from inside the box through the gap at each lateral side;

a respective supply of brush material supported by the sections at the gap at each lateral side of the box, the brush material at each lateral side of the sections extending from the respective section of the box by which it is supported toward the other section of the box in a direction perpendicular to the conveying direction of the sheets and of the gripping means for preventing heat radiation and hot air generated by the IR lamps in the box from passing the brush material and exiting the box through the gaps.

2. The apparatus of claim 1, wherein the IR lamps are supported at one of the sections in the box and a reflector for the lamps is provided at the other section of the box.

3. The apparatus of claim 1, wherein the brush material is flexible to deflect and permit the gripping means to pass in the conveying direction and is adapted to return to the position blocking the gaps after the gripping means pass.

4. The apparatus of claim 3, wherein the brush material is heat insulating and heat resistant.

5. The apparatus of claim 3, wherein the respective brush material on each of the sections are of such a length extending toward the other of the sections and the path of the gripping means in the conveying direction is such that the brush material engages the gripping means as the gripping means move in the conveying direction.

6. The apparatus of claim 3, wherein at each gap, a respective supply of the brush material is provided at each of the sections and extending toward the brush material at the other of the sections for defining at each gap two opposing supplies of the brush material, the brush material of each section having a free end portion directed toward the free end portion of the brush material from the other section, and the brush material from the two sections being of such length that the brush material at each lateral side extends completely over the gaps to cover the gaps, so that the gripping means may pass in the conveying direction along the brush material and between the end portions of the brush material at each gap.

7. The apparatus of claim 6, wherein the length of the brush material, and the position of the brush material and the path of the gripping means along the conveying direction and through and along the gaps are selected so that the free end portions of the brush material are at the same level in the gaps as the gripping means in the conveying path along the gaps.

8. The apparatus of claim 7, wherein the brush material on each section is of such length as to define a line pathway between the free end portions which is at the center of the gap between the sections and the gripping means passes along the line pathway.

9. The apparatus of claim 7, wherein the brush material of each section at each gap meet in the gap and completely close the gap.

10. The apparatus of claim 6, further comprising a respective rail at the gap at each lateral side in each section and the respective brush material is fastened to each rail, the rails being flexible in the conveying direction of the sheets.

* * * * *